US007003977B2

(12) United States Patent
Steinbach et al.

(10) Patent No.: US 7,003,977 B2
(45) Date of Patent: Feb. 28, 2006

(54) CRYOGENIC COOLING SYSTEM AND METHOD WITH COLD STORAGE DEVICE

(75) Inventors: Albert Eugene Steinbach, Schenectady, NY (US); Robert Adolph Ackermann, Schenectady, NY (US); Xianrui Huang, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 38 days.

(21) Appl. No.: 10/604,415

(22) Filed: Jul. 18, 2003

(65) Prior Publication Data

US 2005/0086974 A1 Apr. 28, 2005

(51) Int. Cl.
*F25D 11/00* (2006.01)

(52) U.S. Cl. ..... 62/437; 62/98; 62/99; 62/118; 62/201; 62/430

(58) Field of Classification Search ..... 62/437, 62/430, 98, 99, 118, 201, 434, 431; 165/10, 165/4; 310/52, 54, 57
See application file for complete search history.

(56) References Cited

U.S. PATENT DOCUMENTS 3,630,043 A * 12/1971 Mulder ..... 62/99
4,404,808 A * 9/1983 Andeen ..... 62/6
4,874,677 A * 10/1989 Reiche et al. ..... 428/605
5,429,177 A 7/1995 Yaron et al.
5,513,498 A 5/1996 Ackermann et al.
5,548,168 A 8/1996 Laskaris et al.
5,647,218 A 7/1997 Kuriyama et al.
5,749,243 A * 5/1998 Lester ..... 62/434
6,318,090 B1 11/2001 Gschneidner, Jr. et al.
6,347,522 B1 * 2/2002 Maguire et al. ..... 62/6
6,415,613 B1 7/2002 Ackermann et al.
6,438,969 B1 8/2002 Laskaris et al.
6,442,949 B1 9/2002 Laskaris et al.
6,609,383 B1 8/2003 Kusada et al.
6,640,552 B1 * 11/2003 Rampersad et al. ..... 62/6

FOREIGN PATENT DOCUMENTS

EP 1 276 215 1/2003
JP 11-051583 * 2/1999
JP 2000-186876 7/2000

* cited by examiner

*Primary Examiner*—Cheryl Tyler
*Assistant Examiner*—Richard L. Leung
(74) *Attorney, Agent, or Firm*—Nixon & Vanderhye P.C.

(57) ABSTRACT

A cooling system for providing cryogenic cooling fluid to an apparatus comprises a re-circulation device, a passive cold storage device having a porous matrix of material which directly contacts the cryogenic cooling fluid as the cryogenic cooling fluid passes through the passive cold storage device, a first portion of a fluid communication feed line fluidly connecting the re-circulation device to the passive cold storage device, a second portion of a fluid communication feed line fluidly connecting the passive cold storage device to the apparatus for communicating cryogenic cooling fluid to the apparatus, and a fluid communication return line fluidly connecting the apparatus to the re-circulation device. The passive cold storage device may comprise a regenerative heat exchanger including a porous matrix of metal wire mesh, metal spheres or ceramic spheres.

16 Claims, 5 Drawing Sheets

CRYOGENIC COOLING SYSTEM AND METHOD WITH COLD STORAGE DEVICE

BACKGROUND OF INVENTION

The present invention relates to a cryogenic refrigeration system for cooling a device such as a synchronous machine having a rotor with a high temperature superconducting component.

SUMMARY OF INVENTION

Cryogenic refrigerators are often used to cool a thermal load. Unfortunately, these cryogenic refrigerators (including their compressors) are subject to failures and therefore periodically require repair or replacement. During these periods of reduced refrigeration capacity, the temperature of cryogenic fluid (e.g., gas) circulated by the refrigerator temperature will rise unless the total thermal load on the refrigeration system is reduced to be smaller than the remaining refrigeration capacity. If the thermal load must continue to be cooled without reduction and the remaining refrigeration capacity is smaller than the thermal load, an additional source of cooling is needed until the full refrigeration capacity is restored.

An example of a thermal load that may be cooled by a cryogenic refrigerator is a superconducting field winding of a rotor in a synchronous electrical generator. The field winding is commonly kept at cryogenic temperatures through a cryogenic refrigerator that circulates cold helium gas through a circuit in the rotor. FIG. 5 schematically shows this type of system. If the refrigerator fails, the temperature of the gas will rise and potentially allow the field winding to reach a high enough temperature to quench and cease to be superconducting. Even if the system includes a backup refrigerator unit, it can take many minutes after it is started for the backup refrigerator to provide significant cooling. In that time the field coil can still potentially reach a quench temperature.

This problem of refrigeration failure has previously been addressed by three methods. The first method is to rapidly reduce the thermal load. This method has two disadvantages. First, reducing the thermal load reduces the reliability of the system associated with the thermal load. For example, if the thermal load is a superconducting field winding of an electric generator, the power output of the electric generator must be rapidly reduced thereby resulting in an unreliable power supply. Also, there is a risk that the thermal load may not be reduced fast enough to prevent damage to the object being cooled. For example, there is a risk of quench followed by permanent degradation of the superconducting field winding.

The second method of resolving the problem of refrigeration failure is to provide a refrigeration system that includes redundant refrigerator unit(s). However, if a redundant unit is not started prior to the refrigeration failure, many minutes may have elapsed after it is started for the backup redundant unit to provide significant cooling. In that time the field winding can still potentially reach a quench temperature. Alternatively, the backup redundant refrigerator unit can be run continuously. The disadvantages of this second method include substantially increased costs to buy and operate the extra refrigerator units.

The third method of resolving the problem of refrigeration failure uses a storage tank with a second cryogen in a liquid state as the cooling source during refrigeration outage. This method is schematically shown in FIG. 6 which illustrates a refrigeration system having a storage tank 9 with liquid cryogen. The liquid cryogen will not rise above its saturation temperature until all of the liquid has turned to gas. This system has the following disadvantages:

First, there is added cost for the liquid storage tank and liquid cryogen. Some liquid cryogens, such as Neon, are very expensive.

Second, some of the liquid turns to vapor during heating. There is added cost and complexity to either replace that vapor with liquid or to re-condense it.

Third, the cold gas temperature is tied to the saturation temperature of the available liquid cryogens. For example, the normal saturation temperatures of liquid Nitrogen, Neon, and Hydrogen are 77.4K, 27.1K and 20.3K, respectively. Therefore, using these liquids at atmospheric pressure limits the cold gas to one of these temperatures. Even though the saturation temperatures can be adjusted with liquid pressure, the ability to optimize the gas temperature relative to the properties of the thermal load (e.g., superconducting wire material properties) is still limited.

Fourth, if there is excess refrigeration capacity under some conditions and the liquid is cooled below its freezing point, its pressure will decrease. If the liquid tank pressure drops below ambient pressure, there is a risk of drawing in contaminants (air, oil, dust, etc.). One way to control the temperature is to add heaters for the liquid. However, adding heaters requires greater power consumption, control complexity, hardware cost, and reliability risk.

Accordingly, there remains a need for a cryogenic refrigeration system which provides a very reliable, passive method/system for preventing the temperature of a thermal load from rising unacceptably during repair or replacement of a cryogenic refrigerator or its accompanying hardware.

In one aspect of the present invention, a cooling system provides cryogenic cooling fluid to an apparatus. The system comprises a re-circulation device, a passive cold storage device having a porous matrix of material which directly contacts the cryogenic cooling fluid as the cryogenic cooling fluid passes through the passive cold storage device, a first portion of a fluid communication feed line fluidly connecting the re-circulation device to the passive cold storage device, a second portion of a fluid communication feed line fluidly connecting the passive cold storage device to the apparatus for communicating cryogenic cooling fluid to the apparatus, and a fluid communication return line fluidly connecting the apparatus to the re-circulation device. The passive cold storage device may comprise a regenerative heat exchanger. The porous matrix of material may comprise metal wire mesh, metal spheres, or ceramic spheres. The first portion of the fluid communication feed line may include at least one heat exchanger.

In another aspect of the present invention, a cooling system for providing a cooling fluid to an apparatus comprises a cryogenic refrigerator for cooling the fluid to a first temperature when operating at first refrigeration capacity and cooling the fluid to a second temperature when operating at a second refrigeration capacity, the first temperature being lower than the second temperature and the first refrigeration capacity being higher than the second refrigeration capacity, a passive cold storage device having a porous matrix of material which directly contacts the cryogenic cooling fluid as the cryogenic cooling fluid passes through the passive cold storage device, a first portion of a fluid communication feed line for communicating the fluid cooled by the cryogenic refrigerator to the passive cold storage device, the fluid communicated to the passive cold storage device cooling the passive cold storage device when the fluid has been cooled to the first temperature by the cryogenic refrigerator operating at the first refrigeration capacity and the passive cold storage device cooling the fluid when the fluid has been cooled to the second temperature by the cryogenic refrigerator operating at the second refrigeration capacity, and a second portion of the fluid communication feed line connecting the passive cold storage device to the apparatus for communicating the fluid to the apparatus. The passive cold storage device may comprise a regenerative heat exchanger. The porous matrix of material may comprise metal wire mesh, metal spheres, or ceramic spheres. The passive cold storage device may cool the fluid when the fluid has been cooled to the second temperature and while the refrigeration capacity of the cryogenic refrigerator is being changed to the first refrigeration capacity.

In another aspect of the present invention, a method of providing a cooling fluid to an apparatus comprises cooling the fluid utilizing a cryogenic refrigerator to a first temperature when the cryogenic refrigerator is operating at a first refrigeration capacity and to a second temperature when the cryogenic refrigerator is operating at a second refrigeration capacity, the first temperature being lower than the second temperature and the first refrigeration capacity being higher than the second refrigeration capacity, communicating as part of a fluid circuit, the fluid cooled by the cryogenic refrigerator to a passive cold storage device having a porous matrix of material which directly contacts the cryogenic cooling fluid when the cryogenic cooling fluid passes through the passive cold storage device, the fluid cooling the passive cold storage device when the fluid has been cooled to the first temperature by the cryogenic refrigerator operating at the first refrigeration capacity and the passive cold storage device cooling the fluid when the fluid has been cooled to the second temperature by the cryogenic refrigerator operating at second refrigeration capacity, and communicating, as part of the fluid circuit the fluid from the passive storage device to the apparatus. The passive cold storage device may cool the fluid when the fluid has been cooled to the second temperature and while the refrigeration capacity of the cryogenic refrigerator is being changed to the first refrigeration capacity.

In another aspect of the invention, a cooling system and method provides cryogenic cooling fluid to an apparatus. The system comprises (i) a re-circulation device, (ii) a fluid communication feed line connecting the re-circulation device to the apparatus for communicating the fluid to the apparatus, the fluid communication feed line including: a first passive cold storage device and a second passive cold storage device serially connected downstream from the first passive cold storage device; and (iii) a fluid communication return line connecting the apparatus to the re-circulation device for communicating the fluid from the apparatus to the re-circulation device. At least one of the first and second passive cold storage devices may comprise a porous matrix of material which directly contacts the cryogenic cooling fluid as the cryogenic cooling fluid passes therethrough. The porous matrix of material may comprise a porous matrix of metal wire mesh, a porous matrix of metal spheres, or a porous matrix of ceramic spheres. A first cryogenic refrigerator may be thermally coupled to the first passive cold storage device and a second cryogenic refrigerator may be thermally coupled to the second passive cold storage device. The first cryogenic refrigerator may cool the first passive cold storage device to a first temperature and the second cryogenic refrigerator may cool the second passive cold storage device to a second temperature, the first and second temperatures being different. The first temperature may be higher than the second temperature.

DETAILED DESCRIPTION

Figure 1:
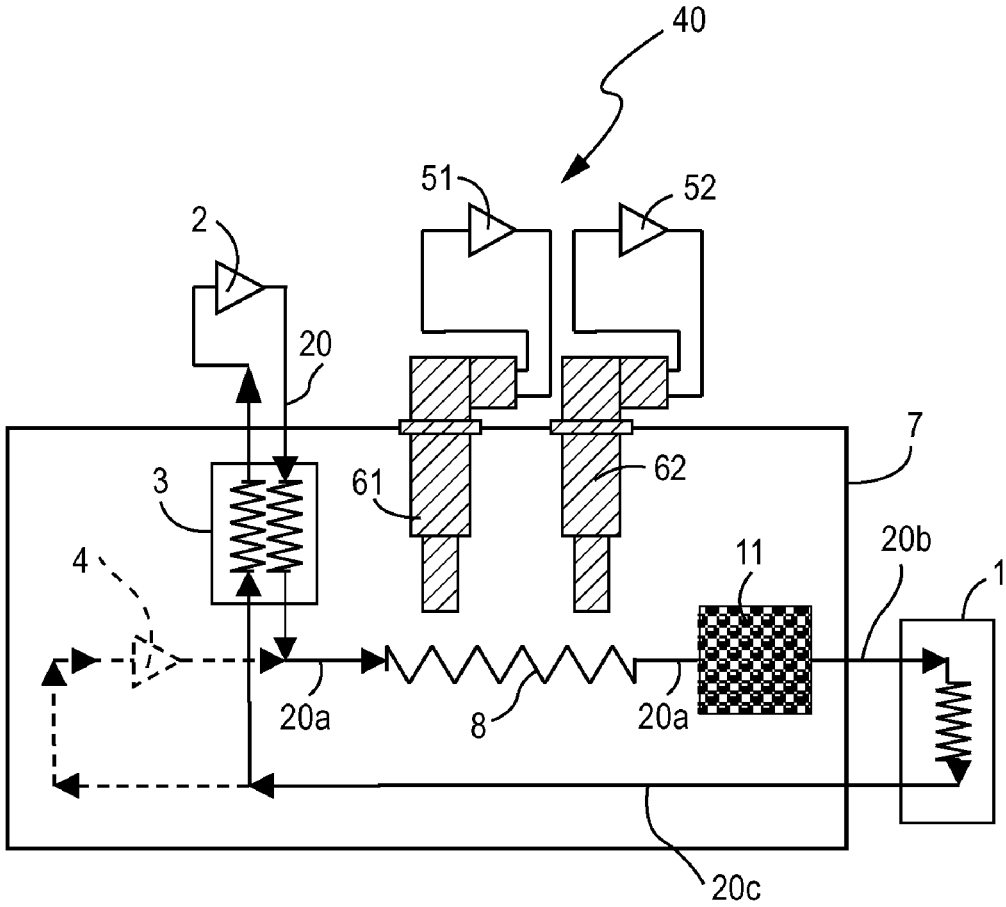
FIG. 1 is a schematic diagram of a cryogenic refrigeration system for supplying cooling fluid to a thermal load in accordance with an exemplary embodiment of the present invention.

FIG. 1 is a schematic diagram of a cryogenic refrigeration system 40 for cooling thermal load 1. Thermal load 1 may be, for example, superconducting field winding coils of a rotor in a synchronous electric generator. While the exemplary embodiments below describe cryogenic refrigeration systems using a compressible gas as a cooling fluid, another cooling fluid such as a liquid may instead be used.

The refrigeration system 40 includes a heat exchanger 3 and a re-circulation device 2 such as a re-circulating compressor (when the cryogenic cooling fluid is a gas), fan or pump. While not shown in FIG. 1, a redundant (i.e., backup) re-circulation device can be connected in parallel with re-circulation device 2 to increase reliability. Re-circulation device 2 compresses and supplies warm temperature gas (e.g., 300°K) to heat exchanger 3. Re-circulation device 2 may include a storage container of cooling fluid. Heat exchanger 3 cools the gas received from re-circulation device 2 to a cryogenic temperature by transferring heat from the compressed gas to the gas returning from thermal load 1.

Gas is re-circulated by re-circulation device 2 through gas circuit 20. Gas circuit 20 includes a fluid feed line having portions 20*a* and 20*b* and a fluid return line 20*c*. Portion 20*a* of the feed line of gas circuit 20 communicates the compressed gas from re-circulating device 2 to heat exchanger 3. Portion 20*a* of the feed line also transports the cryogenic compressed gas from heat exchanger 3 to heat exchanger 8. The heat exchangers 3 and 8 thus essentially form a portion of the exemplary feed line of gas circuit 20.

The cryogenic compressed gas from heat exchanger 3 is further cooled by passing the gas through heat exchanger 8. In particular, heat is transferred from the gas while passing through heat exchanger 8 via cooling provided by cryogenic refrigerators 61, 62 and re-circulating devices 51, 52. In particular, re-circulating device 51 circulates a cooling fluid to and from cryogenic refrigerator 61 and re-circulating device 52 circulates a cooling fluid to and from cryogenic refrigerator 62. Cryogenic refrigerators 61, 62 are arranged within insulated cold box 7 along with heat exchangers 3 and 8. Cryogenic refrigerators 61, 62 are illustrated in FIG. 1 as Gifford-McMahon type refrigerators. However, cryogenic refrigerators 61 and/or 62 may alternatively be formed by a Stirling cooler or a pulse tube.

The gas cooled in heat exchanger 8 is then communicated to cold storage device 11. Cold storage device 11 is a form of a regenerative heat exchanger. Regenerative heat exchangers generally have two modes of operation. In the first mode of operation, cold fluid enters and cools the warm regenerator and leaves with more thermal energy than with which it entered. In the second mode of operation, warm fluid enters and warms the cool regenerator and leaves with less thermal energy than with which it entered. Regenerative heat exchangers are typically filled with a porous matrix such as (i) metal wire mesh, (ii) metal or ceramic spheres, or (iii) metal or ceramic ribbons, which acts like a thermal sponge. Gas received from portion 20*a* of the feed line is directly received by cold storage device 11 as part of the feed line and transported from cold storage device 11 to thermal load 1 by portion 20*b* of the feed line. The porous matrix of passive cold storage device 11 directly contacts the cooling fluid as it is communicated through the passive cold storage device 11 as part of the fluid feed line.

Figure 2A:
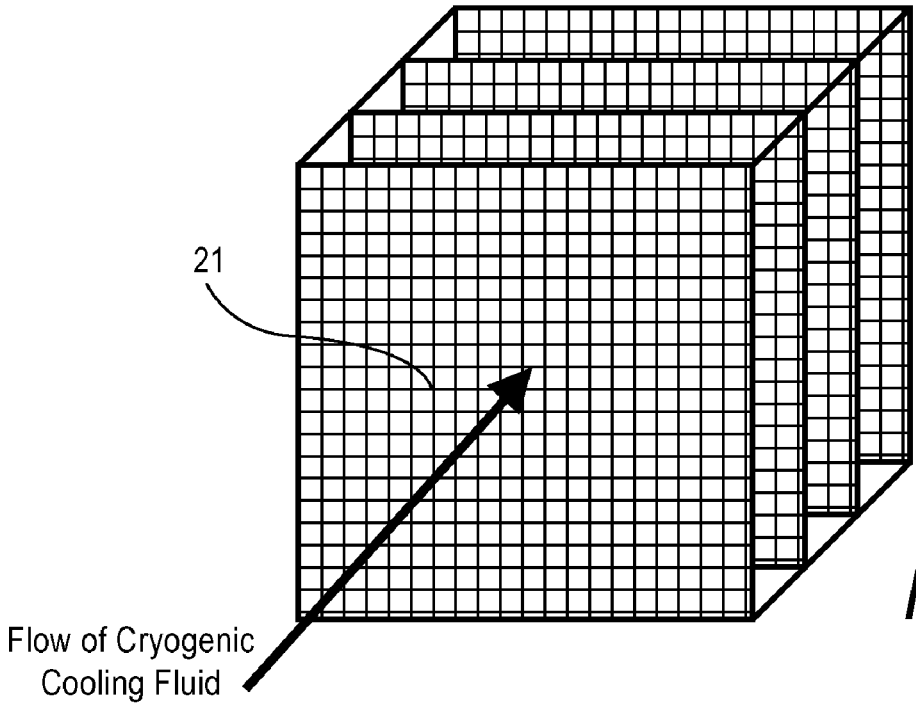
FIG. 2A is a diagram of a material of a passive cold storage device in accordance with an exemplary embodiment of the present invention.
Figure 2B:
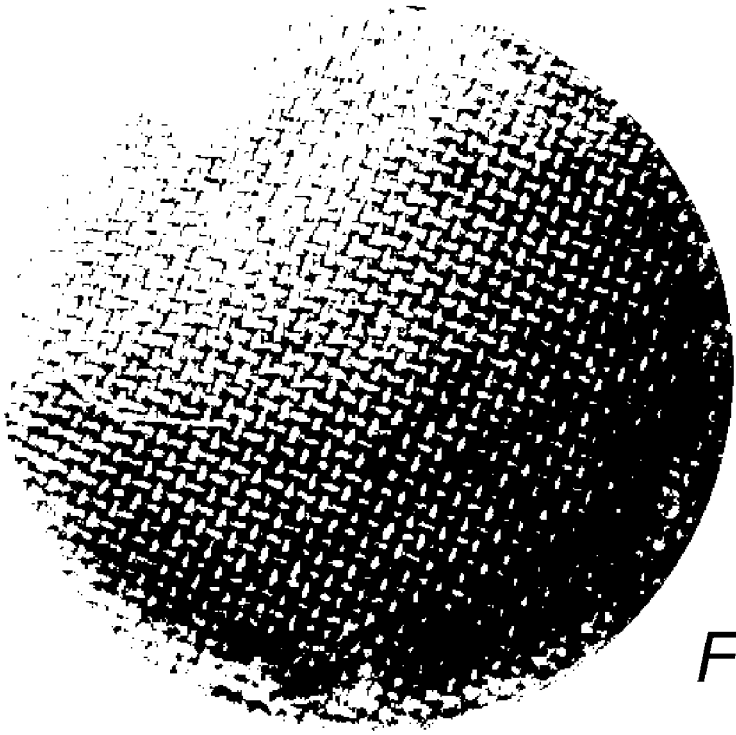
FIG. 2B is an illustration of an impression of the material depicted in the diagram shown in FIG. 2A.
Figure 3A:
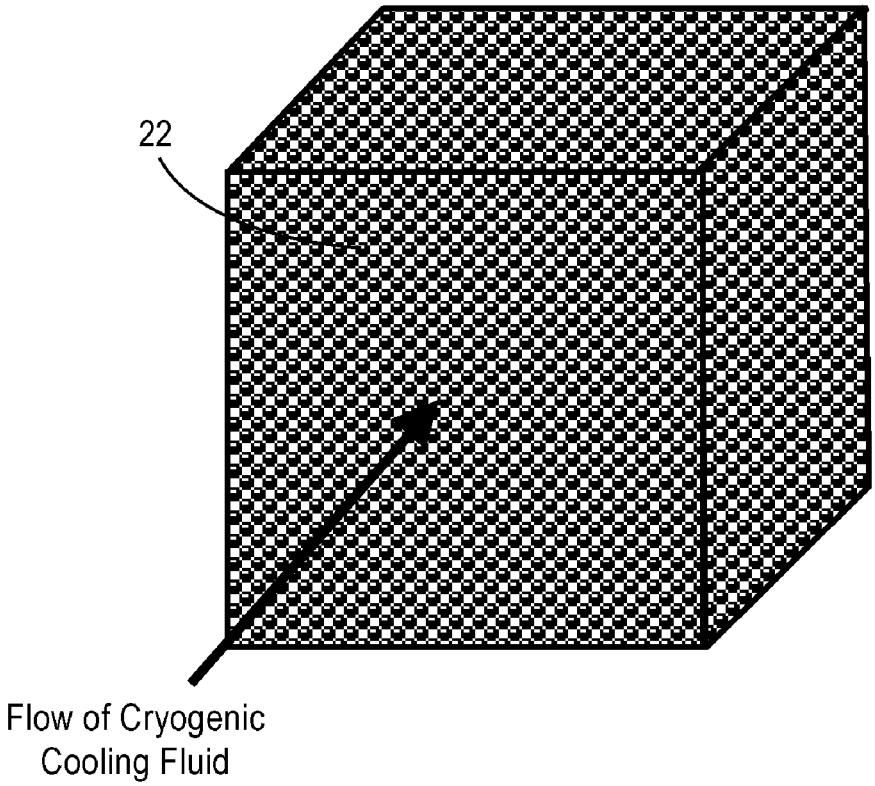
FIG. 3A is a diagram of another material of a passive cold storage device in accordance with another exemplary embodiment of the present invention.
Figure 3B:
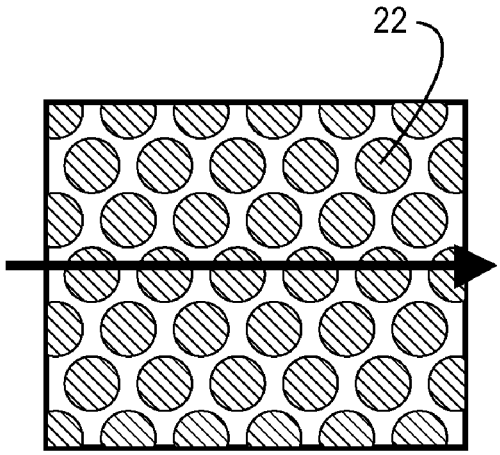
FIG. 3B is a detailed diagram of the material illustrated in FIG. 3A.

FIGS. 2–3 show material forming a portion of cold transfer device 11. In particular, FIGS. 2A–2B illustrate a porous metal wire mesh 21 of a regenerative heat exchanger. The porous metal wire mesh 21 effectively acts like a thermal sponge. FIGS. 3A–3B illustrate a porous matrix of metal or ceramic spheres 22 which forms a part of a regenerative heat exchanger. This porous matrix of metal or ceramic spheres 22 also acts like a thermal sponge. A regenerative heat exchanger stores heat in a combination of solid materials and shapes optimized with respect to high volumetric specific heat and high heat transfer. The materials of the regenerative heat exchangers illustrated in FIGS. 2–3 have in common that they are capable of storing heat coming from a cooling fluid and rejecting heat to a fluid.

Cold storage device 11 reliably and passively enables the gas provided to thermal load 1 via feed line portion 20*b* to be kept from rising to an unacceptable temperature. In particular, cold storage device 11 reliably and passively prevents the temperature of the gas provided to thermal load 1 from rising to a unacceptably high temperature even during repair or replacement of cryogenic refrigerator 61 or 62 or its accompanying hardware.

When cryogenic refrigerators 61 and 62 are operating with a full refrigeration capacity, the gas flowing in the feed line of gas circuit 20 will be cooled to a cryogenic temperature. The gas cooled to this cryogenic temperature flowing through gas circuit 20 will cool cold storage device 11. Accordingly, cryogenic gas flowing through the feed line of gas circuit 20 will cool cold storage device 11 when cryogenic refrigerators 61 and 62 are properly operating at full refrigeration capacity.

However, when refrigeration capacity is reduced (e.g., when cryogenic refrigerator 61 and/or 62 or its accompanying hardware fails to operate properly), the gas flowing through the feed line will likely not be cooled to the same temperature as in the case when refrigerators 61 and 62 are operating properly at full refrigeration capacity. The gas flowing in portion 20*a* of the fluid feed line will thus only be cooled to a temperature which is higher than the temperature that the gas is cooled to during periods of full refrigeration capacity. When the refrigeration capacity is reduced, the gas is not fully cooled and thus additional cooling of the gas is needed before providing the gas to thermal load 1. This additional cooling is provided by cold storage device 11. That is, when the refrigeration capacity of cryogenic refrigerator 61 and/or 62 are reduced, cold storage device 11 will cool the gas so that the gas provided to thermal load 1 does not rise to an unacceptable temperature (i.e., the thermal load is cooled so that it will remain in a superconductive state). Cold storage device 11 will cool the gas for a period while the full refrigeration capacity of cryogenic refrigerator 61 and/or 62 are being restored.

The gas entering thermal load 1 maintains the thermal load (e.g., the superconducting coil of a generator rotor) at cryogenic temperatures by convection heat transfer and ensures that the thermal load may operate in superconducting conditions.

After flowing through and cooling thermal load 1, the circulated gas flows through fluid return line 20*c* of gas circuit 20. Return line 20*c* communicates the gas from thermal load 1 back to re-circulation device 2 via heat exchanger 3. The gas returned to re-circulation device 2 is at a warm temperature. Re-circulation device 2 may then re-circulate the gas by providing it to heat exchanger 3.

As an alternative to re-circulation device 2 and heat exchanger 3 providing gas to feed line portion 20*a*, gas may instead be provided to the feed line portion 20*a* from cold gas circulator/fan 4 (shown in dashed line in order to represent it as an alternative). Cold gas provided from circulator/fan 4 will thus be provided to heat exchanger 8 via feed line portion 20*a*. Since circulator/fan 4 is located within cold box 7, the cooling fluid remains rather cold as it circulates through circulator/fan 4. A heat exchanger thus does not need to be connected downstream from circulator/fan 4. A redundant circulator/fan (not shown in FIG. 1) can be connected to in parallel with circulator/fan 4 to increase the reliability of cooling.

Gas from heat exchanger 8 is passed through cold storage device 11 and then to thermal load 1 via fluid feed line portion 20*b* as discussed above. Warm gas flowing from thermal load 1 is returned to gas circulator/fan 4 via fluid return line portion 20*c*. Cold storage device 11 will be cooled by the gas flowing through it, whether originally from (i) cold gas circulator/fan 4 or (ii) re-circulation device 2 and heat exchanger 3, if the gas has been fully cooled in heat exchanger 8 via proper operation of cryogenic refrigerators 61–62 (e.g., operation of refrigerators 61–62 at full refrigeration capacity). If, however, the gas is not fully cooled (e.g., one or more of cryogenic refrigerators 61–62 is operating at a reduced refrigeration capacity), cold storage device 11 will passively cool the gas passing therethrough as discussed above. The temperature of the gas provided to thermal load 1 is therefore reliably and passively kept at a acceptable cryogenic temperature even when cryogenic refrigerator 61 and/or 62 or its accompanying hardware 51 and/or 52 is being repaired or replaced.

Cold box 7 encloses portions of the fluid feed line portions 20*a*, 20*b*, at least a portion of the fluid return line 20*c*, heat exchangers 3 and 8, at least part of cryogenic refrigerators 61 and 62 and gas circulator/fan 4. Cold box 7 is an insulated portion of the refrigeration system that is maintained at cryogenic temperatures. Cold box 7 may establish a vacuum around the components within the cold box.

Figure 4:
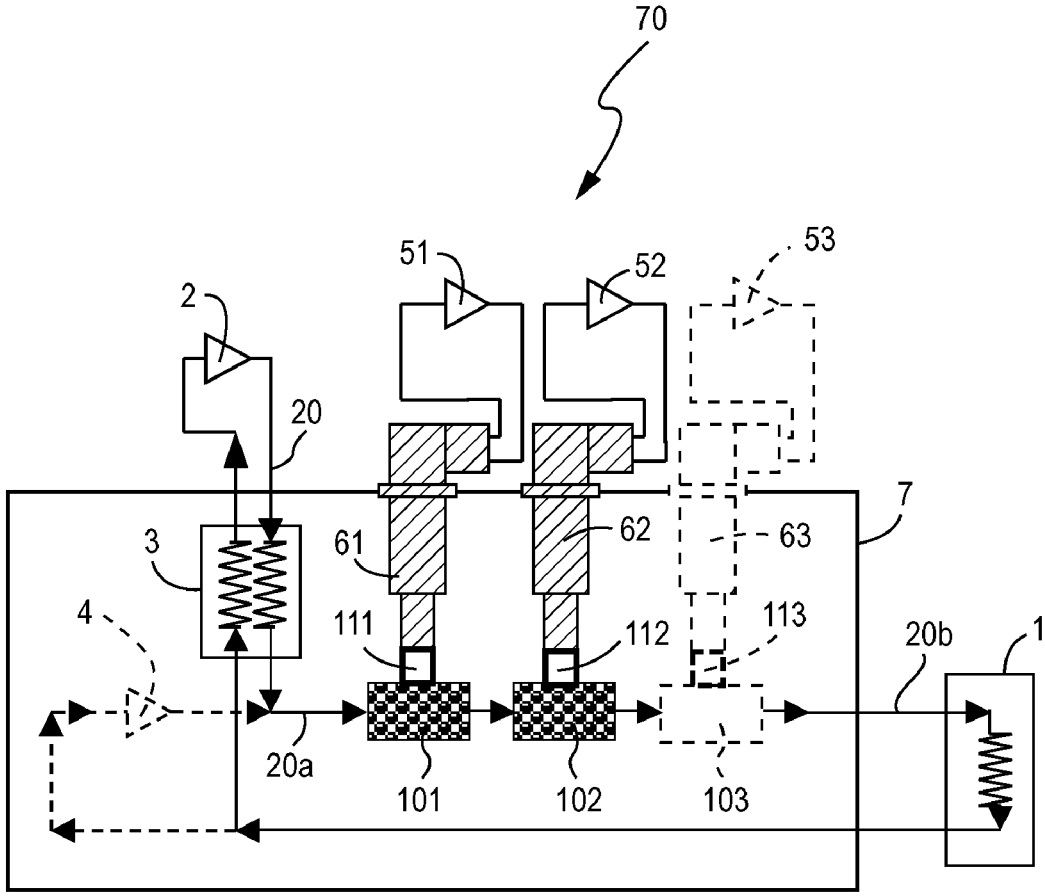
FIG. 4 is a schematic diagram of a cryogenic refrigeration system for supplying cooling fluid to a thermal load in accordance with another exemplary embodiment of the present invention.

FIG. 4 is a schematic diagram of a cryogenic refrigeration system 70 in accordance with a second embodiment of the present invention. The components in cryogenic refrigeration system 70 that are common to the cryogenic refrigeration system 40 illustrated in FIG. 1 have been identified with common reference numbers. Only the differences between cryogenic refrigeration systems 70 and 40 will be discussed in detail.

Cryogenic refrigeration system 70 includes a plurality of passive cold storage devices 101 and 102 connected in series as part of the fluid communication feed line of fluid circuit 20. Thermal connection devices 111 and 112 such as a heat pipes, solid conductive materials, or heat pipe type devices enclosing passive cold storage devices 101 and 102, thermally connect passive cold storage devices 101 and 102 to refrigerators 61 and 62, respectively. Refrigerators 61 and 62 thus cool passive cold storage devices 101 and 102, respectively, in normal operation. Alternatively, multiple refrigerators may cool each passive cold storage device 101 and 102. Each of the passive cold storage devices 101 and 102 may contain a porous matrix of materials as illustrated in FIGS. 2–3. Also, while the exemplary embodiment illustrated in FIG. 4 shows two passive cold storage devices 101 and 102, additional passive cold storage devices may be serially connected, each with one or more refrigerators thermally connected thereto. Cold box 7 encloses at least portions of refrigerators 61 and 62, thermal connection devices 111 and 112, and cold passive storage devices 101 and 102.

The modular design of cryogenic refrigeration system 70 provides several advantages, including higher efficiency and higher reliability. The higher efficiency results from operating individual refrigerators 61 and 62 at different cryogenic temperatures. Refrigerators 61 and 62 will thus cool cold storage devices 101 and 102 to different cryogenic temperatures. The most upstream cold storage device 101 will have the warmest cryogen temperature and each subsequent cold storage device (e.g., device 102) will be cooled by a refrigerator to a progressively cooler temperature. The efficiency of refrigerators generally decreases with their cold temperature, making the refrigerator 61 for the most upstream cold storage device 101 more efficient than each subsequent stage. In addition, since only the most downstream cold storage device must be cooled to the outlet (lowest) temperature, the time needed for system cool-down and warm-up is reduced. The higher reliability is facilitated in two ways. The first is having the ability to form one or more redundant module(s) from a cold storage device, thermal connection and corresponding refrigerator. The second is that only a fraction of the total refrigeration capacity is lost when an individual module is not working properly.

In operation, refrigerator 61 cools cold storage device 101 via thermal connection device 111 to a first cryogenic temperature. Cold storage device 101, in turn, cools the fluid entering cold storage 101 through feed line portion 20*a*. The now cooled fluid exits cold storage device 101 and enters serially connected (downstream) cold storage device 102. Refrigerator 62 cools cold storage device 102 via thermal connection device 112 to a second cryogenic temperature which is lower than the first cryogenic temperature to which refrigerator 61 cools cold storage device 101. Cold storage device 102, in turn, cools the received fluid. If no further cold storage device(s) are serially connected downstream from the cold storage device 102, the cooling fluid exiting cold storage device 102 enters thermal load 1 via feed line portion 20*b*. The fluid then exits thermal load 1 and returns to heat exchanger 3 and re-circulation device 2 (or alternatively, circulator/fan 4) via fluid communication return line 20*c*. If an additional passive cold storage device(s) (e.g., passive cold storage device 103 cooled via thermal connection device 113 by cryogenic refrigerator 63 having re-circulating device 53-illustrated in dashed line in FIG. 4) is serially connected downstream from cold storage device 102, the cooling fluid exiting cold storage device 102 enters the additional passive cold storage device 103 prior to entering thermal load 1 via feed line portion 20*b*. Refrigerator 63 cools cold storage device 103 via thermal connection device 113 to a cryogenic temperature which is lower than the second cryogenic temperature to which refrigerator 62 cools cold storage device 102. Cold storage device 103, in turn, cools the received cooling fluid and passes the fluid to thermal load 1 via feed line portion 20*b* directly or through another (e.g., fourth, fifth, sixth, etc.) downstream passive cold storage device (not shown in FIG. 4).

As noted above, if cold storage device 101, thermal connection device 111 and/or refrigerator 61 fails to operate properly so that cold storage device 101 operates only at a reduced or absent refrigeration capacity, the fluid passing through the fluid feed line is still cooled by cold storage device 102 (presuming that device 102, thermal connection device 112 and refrigerator 62 are operating properly). On the other hand, if cold storage device 102, thermal connection device 112 and/or refrigerator 62 fails to operate properly so that cold storage device 102 operates only at a reduced or absent refrigeration capacity, the fluid passing through the fluid feed line is still cooled by cold storage device 101 (presuming that device 101, thermal connection device 111 and refrigerator 61 are operating properly). Thermal load 1 may thus be cooled in a reliable manner as only a portion of the refrigeration capacity will be lost when one particular refrigeration device fails to properly cool the fluid being communicated to thermal load 1.

Figure 5:
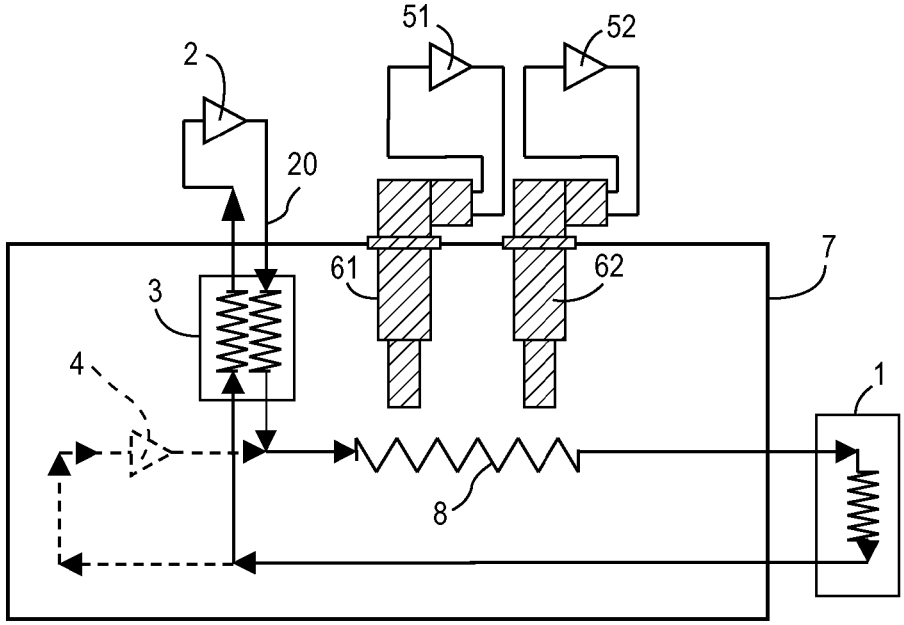
Fig. 5 (Prior Art)
FIG. 5 is a schematic diagram of a known cryogenic refrigeration system for supplying cooling fluid to a thermal load.
Figure 6:
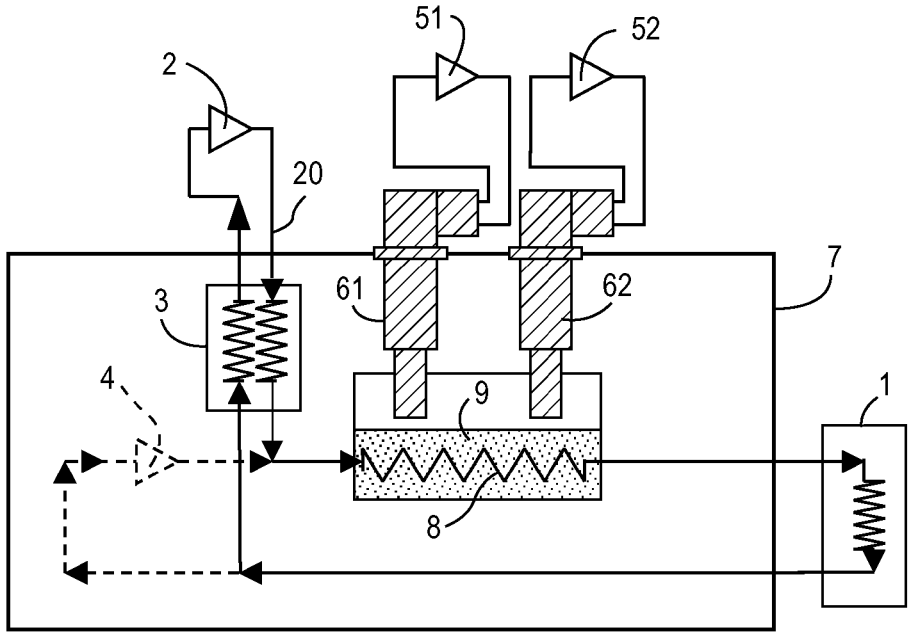
Fig. 6 (Prior Art)
FIG. 6 is a schematic diagram of another known cryogenic refrigeration system for supplying cooling fluid to a thermal load.

As noted above, FIGS. 5 and 6 illustrate known cryogenic refrigeration systems for cooling a thermal load. Components illustrated in FIGS. 5 and 6 which are common to those earlier identified have been labeled with identical reference numbers.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A cooling system for providing cryogenic cooling fluid to an apparatus, the system comprising:

a re-circulation device;

a fluid communication feed line connecting the re-circulation device to the apparatus for communicating the fluid to the apparatus, the fluid communication feed line including:

a first passive cold storage device;

a second passive cold storage device serially connected downstream from the first passive cold storage device; and a fluid communication return line connecting the apparatus to the re-circulation device for communicating the fluid from the apparatus to the re-circulation device;

wherein at least one of the first and second passive cold storage devices comprises a porous matrix of material which directly contacts the cryogenic cooling fluid as the cryogenic cooling fluid passes therethrough.

2. A cooling system as in claim 1 wherein the porous matrix of material comprises a porous matrix of metal wire mesh.

3. A cooling system as in claim 1 wherein the porous matrix of material comprises a porous matrix of metal spheres.

4. A cooling system as in claim 1 wherein the porous matrix of material comprises a porous matrix of ceramic spheres.

5. A cooling system as in claim 1 further comprising a first cryogenic refrigerator thermally coupled to the first passive cold storage device and a second cryogenic refrigerator thermally coupled to the second passive cold storage device.

6. A cooling system as in claim 5 wherein the first cryogenic refrigerator cools the first passive cold storage device to a first temperature and the second cryogenic refrigerator cools the second passive cold storage device to a second temperature, the first and second temperatures being different.

7. A cooling system as in claim 6 wherein the first temperature is higher than the second temperature.

8. A method of providing a cooling fluid to an apparatus, the method comprising:

communicating the fluid to the apparatus through a fluid communication feed line, the fluid communication feed line including a first passive cold storage device and a second passive cold storage device serially connected downstream from the first passive cold storage device; and communicating the fluid from the apparatus to a re-circulating device through a fluid communication return line;

wherein at least one of the first and second passive cold storage devices comprises a porous matrix of material which directly contacts the cryogenic cooling fluid as the cryogenic cooling fluid passes therethrough.

9. A method as in claim 8 wherein the porous matrix of material comprises a porous matrix of metal wire mesh.

10. A method as in claim 8 wherein the porous matrix of material comprises a porous matrix of metal spheres.

11. A method as in claim 8 wherein the porous matrix of material comprises a porous matrix of ceramic spheres.

12. A method as in claim 8 further comprising thermally coupling a first cryogenic refrigerator to the first passive cold storage device and thermally coupling a second cryogenic refrigerator to the second passive cold storage device.

13. A method of providing a cooling fluid to an apparatus, the method comprising:

communicating the fluid to the apparatus through a fluid communication feed line, the fluid communication feed line including a first passive cold storage device and a second passive cold storage device serially connected downstream from the first passive cold storage device;

communicating the fluid from the apparatus to a re-circulating device through a fluid communication return line; and thermally coupling a first cryogenic refrigerator to the first passive cold storage device and thermally coupling a second cryogenic refrigerator to the second passive cold storage device;

wherein the first cryogenic refrigerator cools the first passive cold storage device to a first temperature and the second cryogenic refrigerator cools the second passive cold storage device to a second temperature, the first and second temperatures being different.

14. A method as in claim 13 wherein the first temperature is higher than the second temperature.

15. A method as in claim 14 wherein at least a third passive cold storage device is connected downstream from the second passive cold storage device, the third passive cold storage device being cooled by a third cryogenic refrigerator to a third temperature, the second temperature being higher than the third temperature.

16. A cooling system for providing cryogenic cooling fluid to an apparatus, the system comprising:

a re-circulation device;

a fluid communication feed line connecting the re-circulation device to the apparatus for communicating the fluid to the apparatus, the fluid communication feed line including:

a first passive cold storage device;

a second passive cold storage device serially connected downstream from the first passive cold storage device;

a fluid communication return line connecting the apparatus to the re-circulation device for communicating the fluid from the apparatus to the re-circulation device; and a first cryogenic refrigerator thermally coupled to the first passive cold storage device and a second cryogenic refrigerator thermally coupled to the second passive cold storage device;

wherein the first cryogenic refrigerator cools the first passive cold storage device to a first temperature and the second cryogenic refrigerator cools the second passive cold storage device to a second temperature, the first temperature being higher than the second temperature; and the cooling system further comprises at least a third passive cold storage device, the third passive cold storage device being cooled by a third cryogenic refrigerator to a third temperature, the second temperature being higher than the third temperature.

* * * * *